US006003700A

United States Patent [19]

Julian et al.

[11] Patent Number: 6,003,700

[45] Date of Patent: Dec. 21, 1999

[54] SAFETY CLOSURE AND CONTAINER

[75] Inventors: Randall K. Julian, Newburgh; C. Edward Luker, Evansville, both of Ind.

[73] Assignee: Rexam Plastics Inc., Evansville, Ind.

[21] Appl. No.: 09/053,331

[22] Filed: Apr. 1, 1998

[51] Int. Cl.[6] ..... B65D 55/02

[52] U.S. Cl. ..... 215/216; 215/217; 220/281

[58] Field of Search ..... 215/213, 214, 215/216–221, 301, 295, 329, 316; 220/281

[56] References Cited

U.S. PATENT DOCUMENTS

| | | | |
|---|---|---|---|
| 3,115,979 | 12/1963 | Barvin . | |
| 3,339,770 | 9/1967 | Weigand . | |
| 3,435,975 | 4/1969 | Weigand . | |
| 3,472,411 | 10/1969 | Turner . | |
| 3,484,016 | 12/1969 | Turner . | |
| 3,667,636 | 6/1972 | Landen . | |
| 3,841,514 | 10/1974 | Montgomery et al. . | |
| 3,917,097 | 11/1975 | Uhlig . | |
| 3,944,101 | 3/1976 | Landen et al. . | |
| 3,949,893 | 4/1976 | Uhlig | 215/216 |
| 3,951,289 | 4/1976 | Landen . | |
| 3,984,021 | 10/1976 | Uhlig . | |
| 4,117,945 | 10/1978 | Mumford . | |
| 4,138,028 | 2/1979 | Price et al. . | |
| 4,154,354 | 5/1979 | Ryder | 215/216 |
| 4,180,178 | 12/1979 | Turner | 220/281 |
| 4,187,953 | 2/1980 | Turner | 220/281 X |
| 4,213,534 | 7/1980 | Montgomery . | |
| 4,351,442 | 9/1982 | Summers . | |
| 4,444,327 | 4/1984 | Hedgewick . | |
| 4,500,006 | 2/1985 | Lafortune et al. | 220/281 X |
| 4,535,905 | 8/1985 | Sandhaus | 215/218 |
| 4,620,640 | 11/1986 | Swartzbaugh . | |
| 4,842,135 | 6/1989 | Borst et al. | 220/281 X |
| 4,913,299 | 4/1990 | Petro . | |
| 5,147,052 | 9/1992 | Minette . | |
| 5,147,059 | 9/1992 | Olsen et al. | 220/281 |
| 5,238,130 | 8/1993 | Marques et al. . | |
| 5,449,077 | 9/1995 | Seidler . | |
| 5,836,467 | 11/1998 | Montgomery | 215/216 |

FOREIGN PATENT DOCUMENTS

| | | |
|---|---|---|
| 2339539 | 8/1977 | France . |

*Primary Examiner*—Stephen P. Garbe
*Assistant Examiner*—Robin A. Hylton
*Attorney, Agent, or Firm*—Middleton & Reutlinger; John F. Salazar; Charles G. Lamb

[57] ABSTRACT

A safety closure providing a top wall, an annular outer wall depending downwardly from an outer periphery of the top wall, an annular inner wall depending downwardly from an underside surface of the top wall, and, at least one locking lug integrally molded with the outer wall, whereby downward displacement of the top wall causes outward displacement of the at least one locking lug.

8 Claims, 8 Drawing Sheets

SAFETY CLOSURE AND CONTAINER

BACKGROUND OF THE INVENTION

1. Technical Field of the Invention

The present invention relates to safety closures for use on containers. More particularly, the present invention relates to a safety closure for use on a container wherein the safety closure and the container are provided with cooperating means to inhibit access thereto.

2. Description of the Related Art

It is often desirable to provide a safety closure for use on a container wherein the safety closure and the container are respectively provided with cooperating locking means to inhibit access thereto by individuals of tender age. It is well-known in the prior art to threadingly fit a safety closure upon a neck portion of a container, wherein engageable lugs project inwardly from opposing mating surfaces of the safety closure and outwardly from opposing surface of the container neck, respectively. The cooperation of the engaged locking lugs and the threaded fit therebetween prevents removal rotation of the safety closure without first overcoming the engagement of the lugs. It is therefore desirable to provide a safety closure threadingly fit upon a container neck, wherein the safety closure and the container neck are provided with cooperating locking means.

Typically, safety closures of the prior art include a side wall having opposed locking lugs projecting inwardly therefrom, wherein the side wall is deformable upon application of an external force. For example, U.S. Pat. No. 3,667,636 to Landen provides a safety closure frictionally fit upon a container neck and being removable therefrom only after an annulus portion thereof is deformed downwardly a sufficient distance to permit a plurality of locking lugs projecting inwardly therefrom to overcome a plurality of locking formulations projecting outwardly from the container neck. However, it is further desirable to provide a safety closure threadingly fit upon a container neck and secured thereto by engagement between cooperating locking lugs provided respectively thereon, wherein the safety closure is threadingly removable from the container neck by moving the safety closure locking lugs radially-outwardly from the container neck locking lugs.

For example, U.S. Pat. No. 3,770,153 to Gach, et al., teaches a safety closure having locking lugs engageable with cooperating locking lugs provided on a container neck, wherein the safety closure locking lugs are radially outwardly-moveable upon application of radially inwardly-directed forces at locations on the safety closure annularly offset from the locking lugs. However, it is further desirable to provide a safety closure threadingly fit upon a container neck and secured thereto by engagement between cooperating locking lugs provided respectively thereon, wherein the safety closure is threadingly removable from the container neck by moving the safety closure locking lugs radially-outwardly from the container neck locking lugs, and wherein the safety closure locking lugs are radially outwardly-moveable upon application of downwardly-directed force to the safety closure.

It is further desirable to provide a safety closure threadingly fit upon a container neck and secured thereto by engagement between cooperating locking lugs provided respectively thereon, wherein the safety closure is threadingly removable from the container neck by moving the safety closure locking lugs radially-outwardly from the container neck locking lugs, and wherein the container neck is provided with means to move the safety closure locking lugs radially-outwardly from the container locking lugs.

SUMMARY OF THE INVENTION

The present invention is for a safety closure for use on a container to inhibit access thereto by individuals of tender age. The safety closure is threadingly fit upon a neck portion of the container and is secured thereto by cooperating locking lugs respectively provided thereon. Removal of the safety closure from the container neck requires disengagement of the cooperating locking lugs and unthreading of the safety closure therefrom. Disengagement of the cooperating locking lugs is accomplished by applying downwardly-directed axial force to an outer periphery of the safety closure at locations annularly spaced between locations immediately above the locking lugs, whereby a lower end of the side wall moves axially-downwardly and radially-inwardly immediately below the applied force, thereby causing the lower end of the side wall to move radially-outwardly at locations near the locking lugs. Once each locking lug has moved radially outwardly a sufficient distance to overcome its respective container neck locking lug, the safety closure may be unthreaded from the container neck and removed therefrom.

It is an object of the present invention to provide a safety closure threadingly fit upon a container neck, wherein the safety closure and the container neck are provided with cooperating locking means.

It is another object of the present invention to provide a safety closure threadingly fit upon a container neck and secured thereto by engagement between cooperating locking lugs provided respectively thereon, wherein the safety closure is threadingly removable from the container neck by moving the safety closure locking lugs radially-outwardly from the container neck locking lugs.

It is yet another object of the present invention to provide a safety closure threadingly fit upon a container neck and secured thereto by engagement between cooperating locking lugs provided respectively thereon, wherein the safety closure is threadingly removable from the container neck by moving the safety closure locking lugs radially-outwardly from the container neck locking lugs, and wherein the safety closure locking lugs are radially outwardly-moveable upon application of downwardly-directed force to the safety closure.

It is still another object of the present invention to provide a safety closure threadingly fit upon a container neck and secured thereto by engagement between cooperating locking lugs provided respectively thereon, wherein the safety closure is threadingly removable from the container neck by moving the safety closure locking lugs radially-outwardly from the container neck locking lugs, and wherein the container neck is provided with means to move the safety closure locking lugs radially-outwardly from the container locking lugs.

A safety closure for use with a container having means to receive a closure locking lug in locking engagement therewith includes a top wall, an annular outer wall depending downwardly from an outer periphery of the top wall, an annular inner wall depending downwardly from an underside surface of the top wall, and, at least one locking lug integrally molded with the outer wall, whereby downward displacement of the top wall causes outward displacement of the at least one locking lug from the container means to receive a closure locking lug when in a locking relation therewith.

BRIEF DESCRIPTION OF THE SEVERAL VIEWS OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
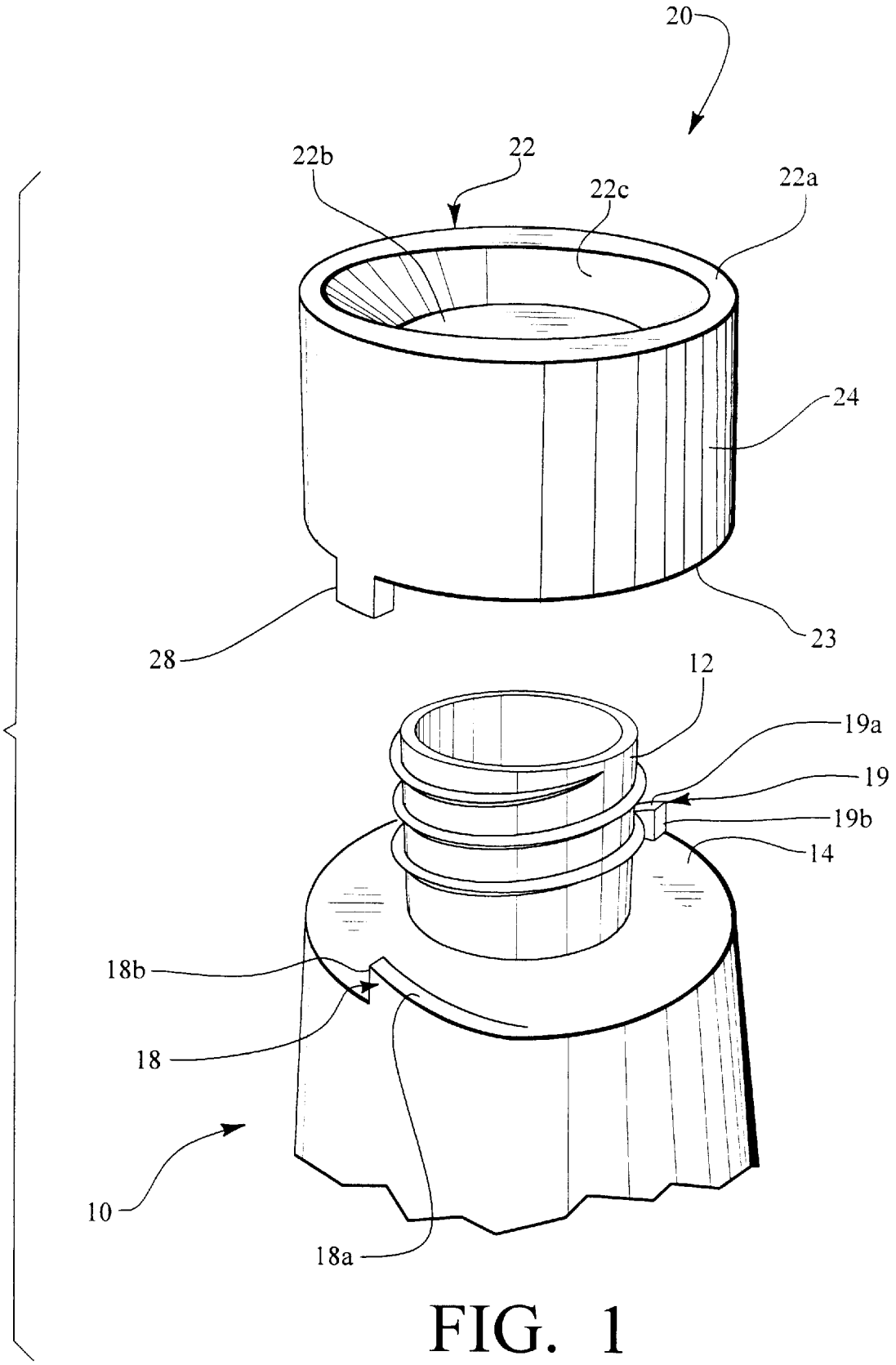
FIG. 1 is a perspective view of a safety closure according to a preferred embodiment of the present invention, shown in spaced relation to a neck portion of a container.

With reference to FIGS. 1, 2, 3 and 4, a safety closure 20 according to a preferred embodiment of the present invention for threaded attachment onto a container 10 includes a non-planar top wall 22, an annular outer wall 24 depending downwardly from an outer periphery of the top wall 22 and an annular inner wall 25 depending downwardly from an underside surface of the top wall 22. The container 10 includes a neck portion 12 projecting upwardly from a shoulder 14 integrally molded with an upper end of the container 10. An external thread 16 is provided on an outer surface of the neck portion 12 and is sized to threadingly engage an internal thread 26 provided on an inner surface of the safety closure inner wall 25. The safety closure 20 and the container 10 are constructed from an integrally-molded, flexible and elastic polymer, such as, for example, polyethylene or polypropylene.

The top wall 22 is substantially non-planar and includes an annular first top wall portion 22*a*, a circular second top wall portion 22*b* disposed downwardly therefrom and connected thereto by a downward conical taper 22*c*. The first top wall portion 22*a* includes an outer diameter defined by the outer periphery of the top wall 22 and an inner diameter disposed inwardly therefrom, the inner diameter being coaxial to and coplanar with the outer diameter. The second top wall portion 22*b* includes an outer diameter disposed inwardly from the first top wall portion inner diameter, the second top wall portion outer diameter being coaxial to the first top wall portion inner diameter, but not being coplanar therewith. The first top wall portion inner diameter, the second top wall portion outer diameter and the downward taper 22*c* cooperate to form an open region having a shape and volume similar to an inverted frustum of a right-circular cone. As stated above, but now with more particularity, the outer wall 24 depends downwardly from the first top wall portion 22*a* towards the outer diameter thereof, whereas the inner wall 25 depends downwardly from an underside surface of the second top wall portion 22*b*. The outer wall 24 and the inner wall 25 are preferably cylindrical in shape and in coaxial relationship.

A pair of locking lugs 28, 29 depend downwardly from a lower end 23 of the outer wall 24 at diametrically-opposed locations. A pair of ramps 18, 19 project upwardly from the container shoulder 14 towards an outer periphery thereof at diametrically-opposed locations and are sized to engage locking lugs 28, 29. Alternatively, ramps 18, 19 may project radially-outwardly from either the shoulder 14 or the container neck portion 12, or other similar means may be employed to provide locking means.

The locking lugs 28, 29 and the ramps 18, 19 are respectively sized and shaped to provide a locking means by which removal of the safety closure 20 from the container neck portion 12 is inhibited. More particularly, as the safety closure 20 is threadingly fit downwardly onto the container neck portion 12 by cooperative engagement of the safety closure internal thread 26 with the container neck portion external thread 16, the locking lugs 28, 29 are guided over inclines 18*a*, 19*a* and behind abutments 18*b*, 19*b*. The outer wall 24 is sufficiently flexible to permit deformation thereof as the locking lugs 28, 29 pass upwardly over the inclines 18*a*, 19*a* and beyond the abutments 18*b*, 19*b*. Further, the outer wall 24 is sufficiently elastic to permit the locking lugs 28, 29 to snap downwardly behind the abutments 18*b*, 19*b* once positioned therebehind, thereby preventing removal rotation of the safety closure 20 relative to the container neck portion 12 unless the locking lugs 28, 29 are permitted to overcome the abutments 18*b*, 19*b*.

Figure 2:
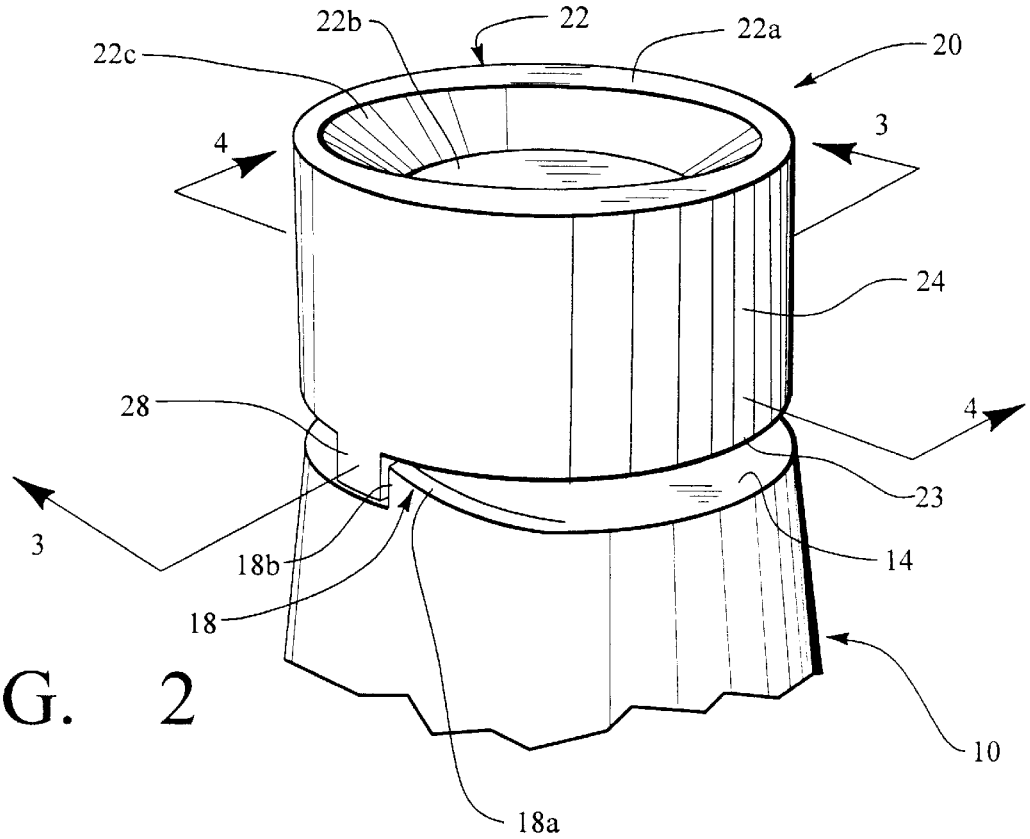
FIG. 2 is a perspective view of the safety closure and container neck portion of FIG. 1, wherein the safety closure is shown affixed to the container neck portion in an undeformed orientation.
Figure 2A:
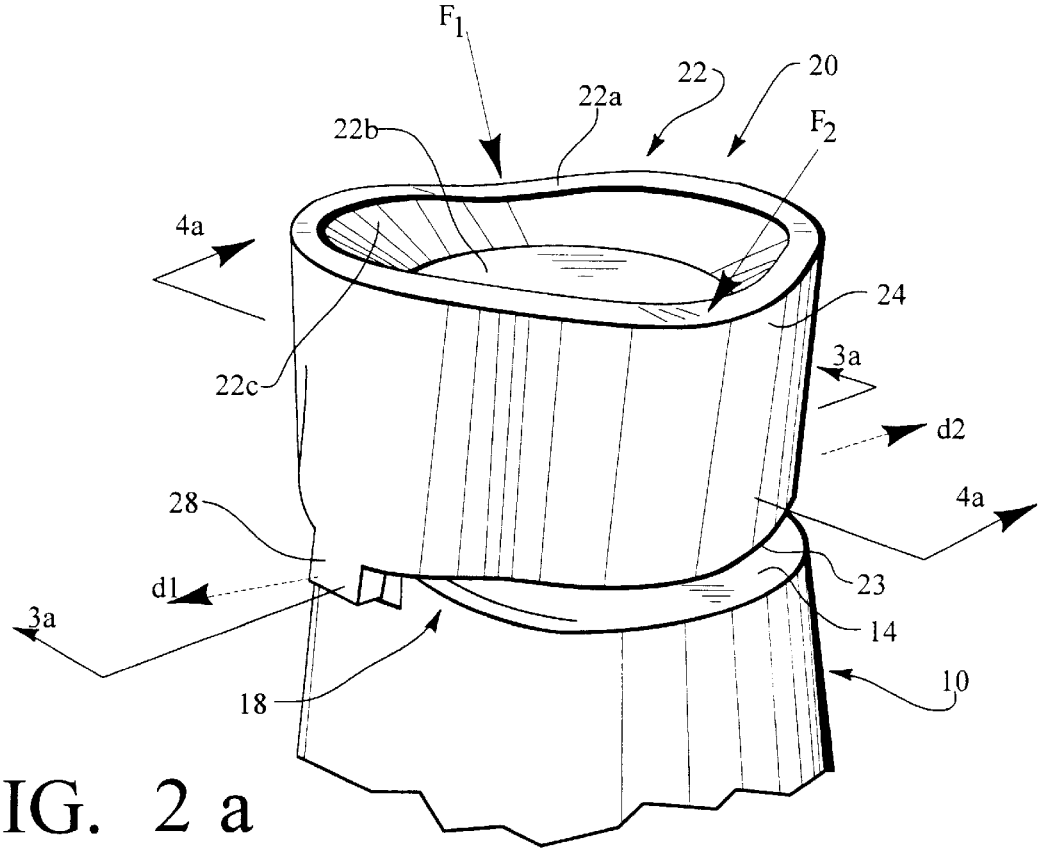
FIG. 2*a* is a perspective view of the safety closure and container neck portion of FIG. 1, wherein the safety closure is shown affixed to the container neck portion in a deformed orientation.
Figure 3:
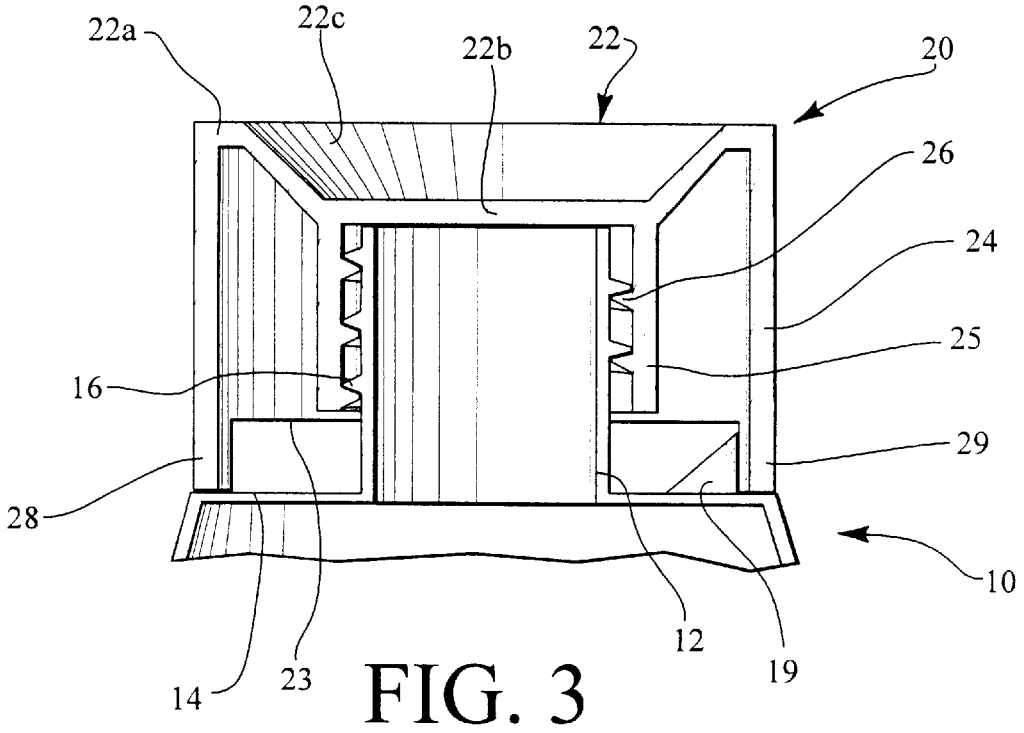
FIG. 3 is a sectional view of the safety closure and container neck portion of FIG. 2, shown along section line 3—3 of FIG. 2.
Figure 3A:
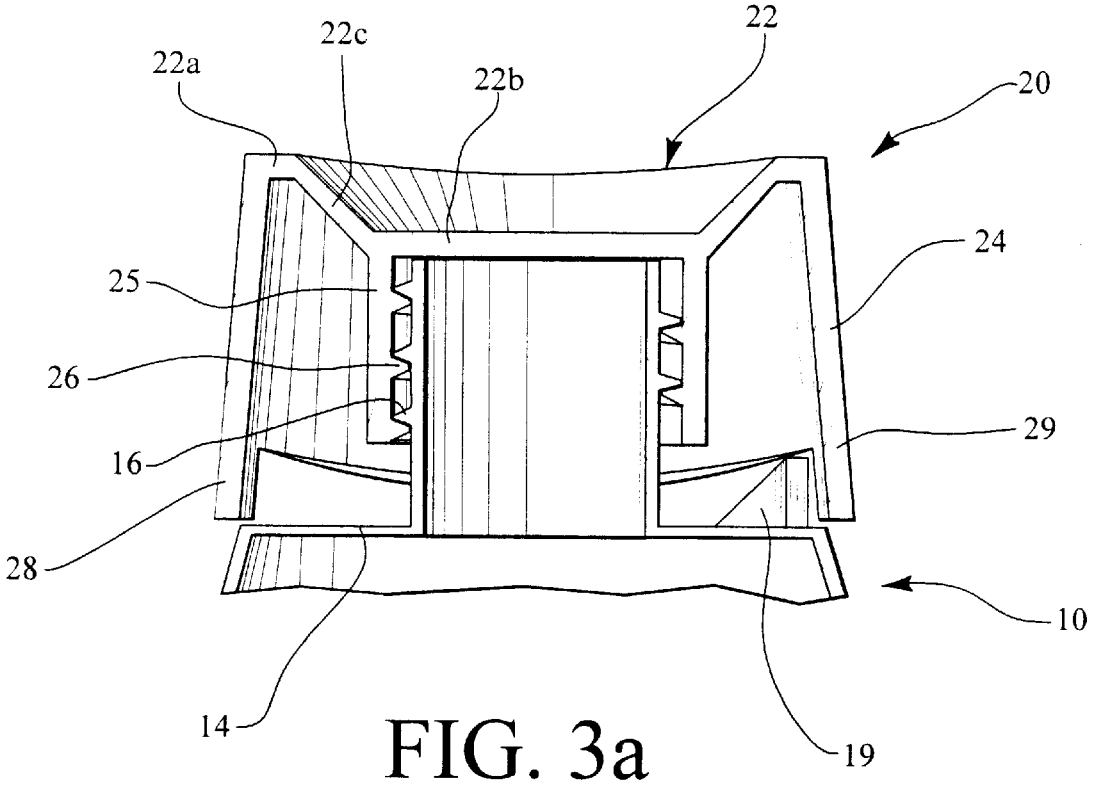
FIG. 3*a* is a sectional view of the safety closure and container neck portion of FIG. 2*a*, shown along section line 3*a*—3*a* of FIG. 2*a;*
Figure 4:
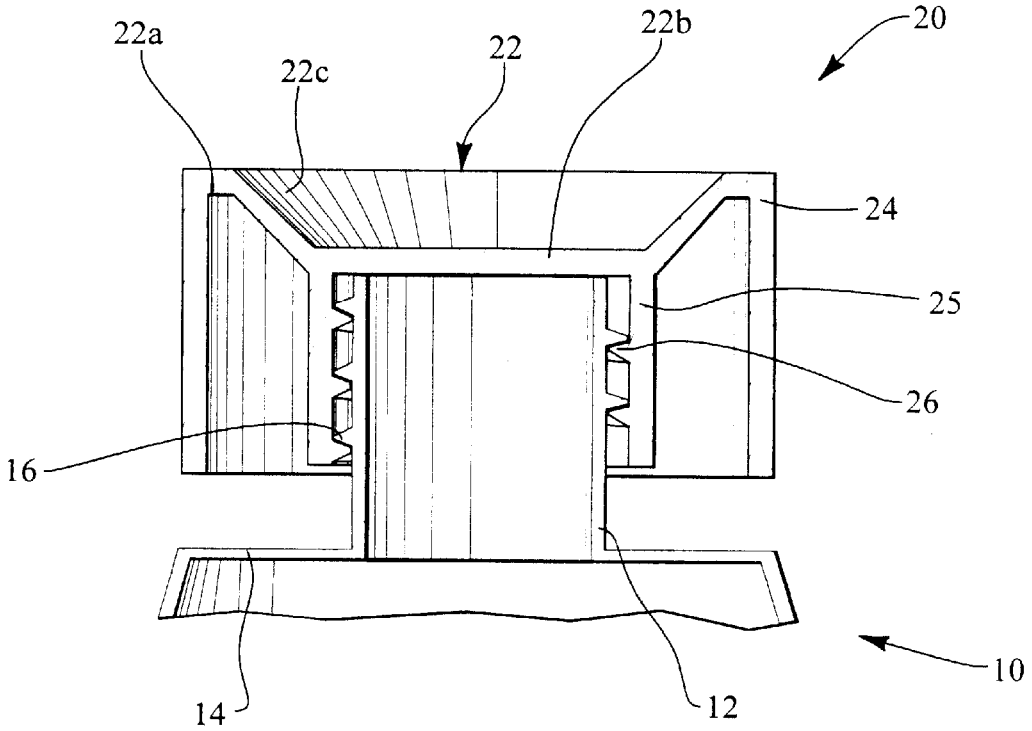
FIG. 4 is a sectional view of the safety closure and container neck portion of FIG. 2, shown along section line 4—4 of FIG. 2.
Figure 4A:
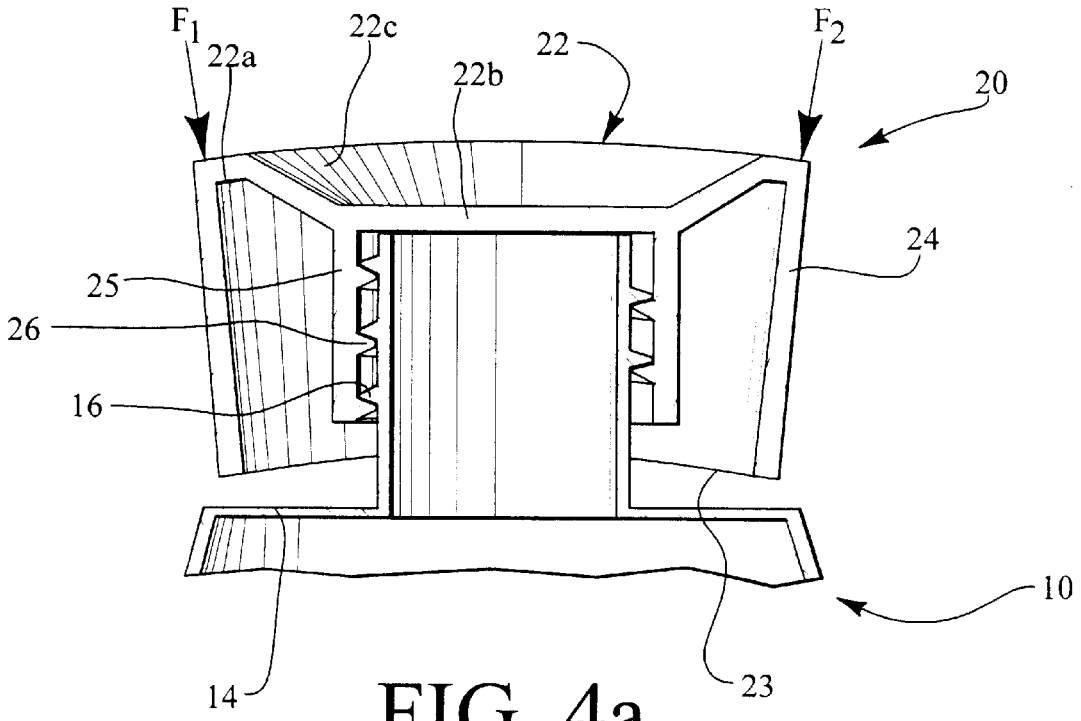
FIG. 4*a* is a sectional view of the safety closure and container neck portion of FIG. 2*a*, shown along section line 4*a*—4*a* of FIG. 2*a;*
Figure 5:
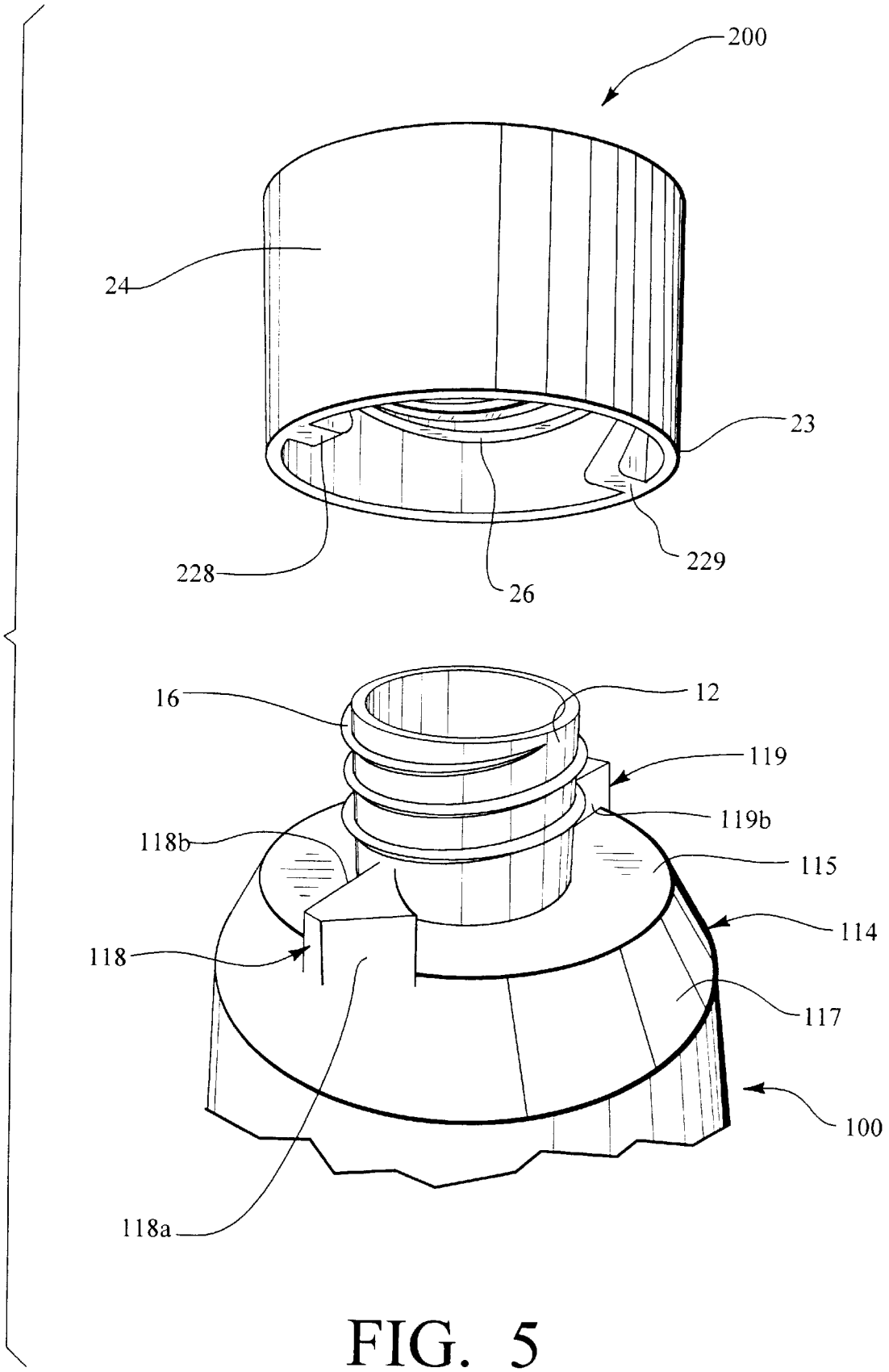
FIG. 5 is a perspective view of a safety closure according to an alternative embodiment of the present invention, shown in spaced relation to a container neck portion.

With reference to FIGS. 2*a*, 3*a* and 4*a*, the locking lugs 28, 29 are radially-outwardly moveable in the directions generally indicated by reference arrows "$d_1$" and "$d_2$" to overcome their respective abutments 18*b*, 19*b* provided by the ramps 18, 19 by applying downwardly-directed force to the first top wall portion 22*a* of the top wall 22 and in the directions generally indicated by reference arrows at force points "$F_1$" and "$F_2$". Preferably, pressure applied at force points "$F_1$", "$F_2$" is transferred to the top wall 22 at annular locations offset from the annular locations of the locking lugs 28, 29 by about 90°.

Pressure applied at force points "$F_1$", "$F_2$" cause the flexible outer wall 24 to pivot axially-downwardly and radially-inwardly about the outer diameter of the second top wall portion 22*b*, which remains substantially rigid and undeformed due to the internal thread 26 and the container neck portion 12 threadingly engaged therewith. The lower end 23 of the outer wall 24 assumes a substantially elliptical shape, wherein regions thereof immediately below the locations of force points "$F_1$", "$F_2$" are moved axially-downwardly and radially-inwardly. In response thereto, arcuate regions of the lower end 23 of the side wall 24 near the locking lugs 28, 29 move axially-upwardly and radially-outwardly beyond their respective abutments 18*b*, 19*b* of ramps 18, 19. Removal rotation of the safety closure 20 may then be applied to remove the safety closure 20 from the container neck portion 12.

With reference to FIGS. 5, 6, 7 and 8, a safety closure 200 according to another embodiment of the present invention for threaded attachment onto a container 100 includes many components in common with the preferred embodiment described hereinabove and like reference numerals are intended to represent like components. However, the safety closure 200 according to the present embodiment includes a pair of locking lugs 228, 229 projecting inwardly from an inner surface of the outer wall 24 at diametrically-opposed locations. The container 100 includes a shoulder 114 having a flattened portion 115 and a sloped portion 117 connecting the flattened portion 115 to an upper end of the container 100. A pair of stops 118, 119 project upwardly from the shoulder 114 at diametrically-opposed locations and are sized to engage locking lugs 128, 129, respectively.

The locking lugs 228, 229 and the stops 118, 119 are respectively sized and shaped to provide a locking means by which removal of the safety closure 200 from the container neck portion 12 is inhibited. More particularly, as the safety closure 200 is threadingly fit downwardly onto the container neck portion 12 by cooperative engagement of the safety closure internal thread 26 with the container neck portion external thread 16, the locking lugs 228, 229 are guided over inclines 118*a*, 119*a* and behind abutments 118*b*, 119*b*. The outer wall 24 is sufficiently flexible to permit deformation thereof as the locking lugs 228, 229 pass upwardly over the inclines 118*a*, 119*a* and beyond the abutments 118*b*, 119*b*. Further, the outer wall 24 is sufficiently elastic to permit the locking lugs 228, 229 to snap inwardly behind the abutments 118*b*, 119*b* once positioned therebehind, thereby preventing removal rotation of the safety closure 200 relative to the container neck portion 12 unless the locking lugs 228, 229 are permitted to overcome the abutments 118*b*, 119*b*.

Figure 6:
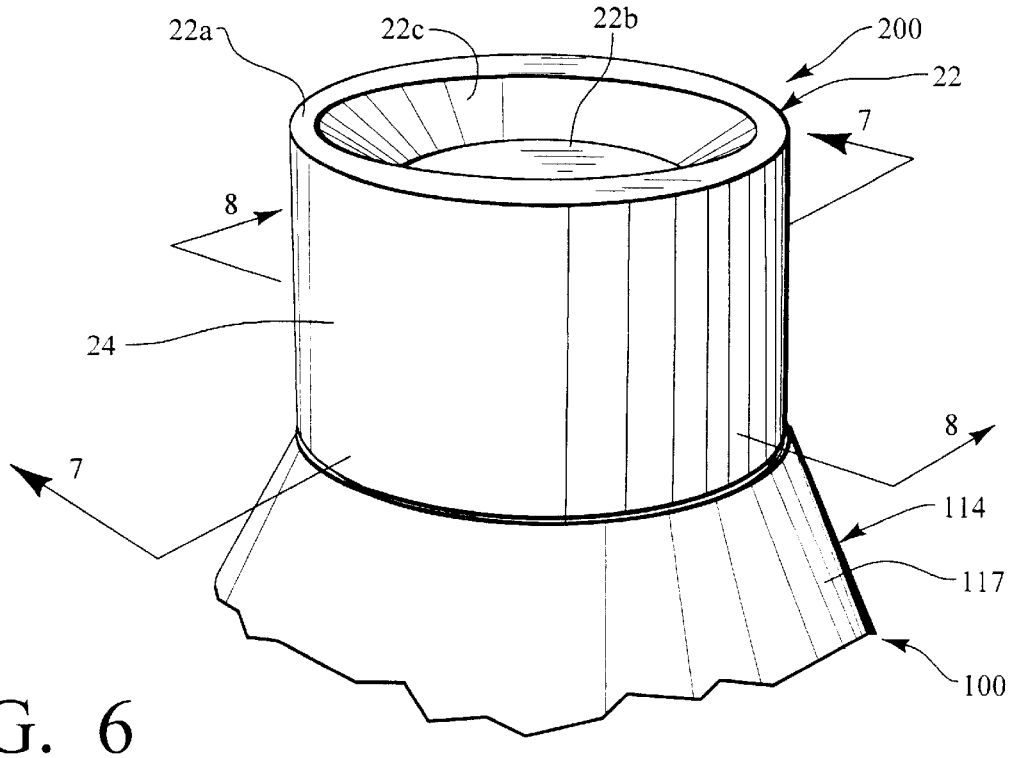
FIG. 6 is a perspective view of the safety closure and container neck portion of FIG. 5, wherein the safety closure is shown affixed to the container neck portion in an undeformed orientation.
Figure 6A:
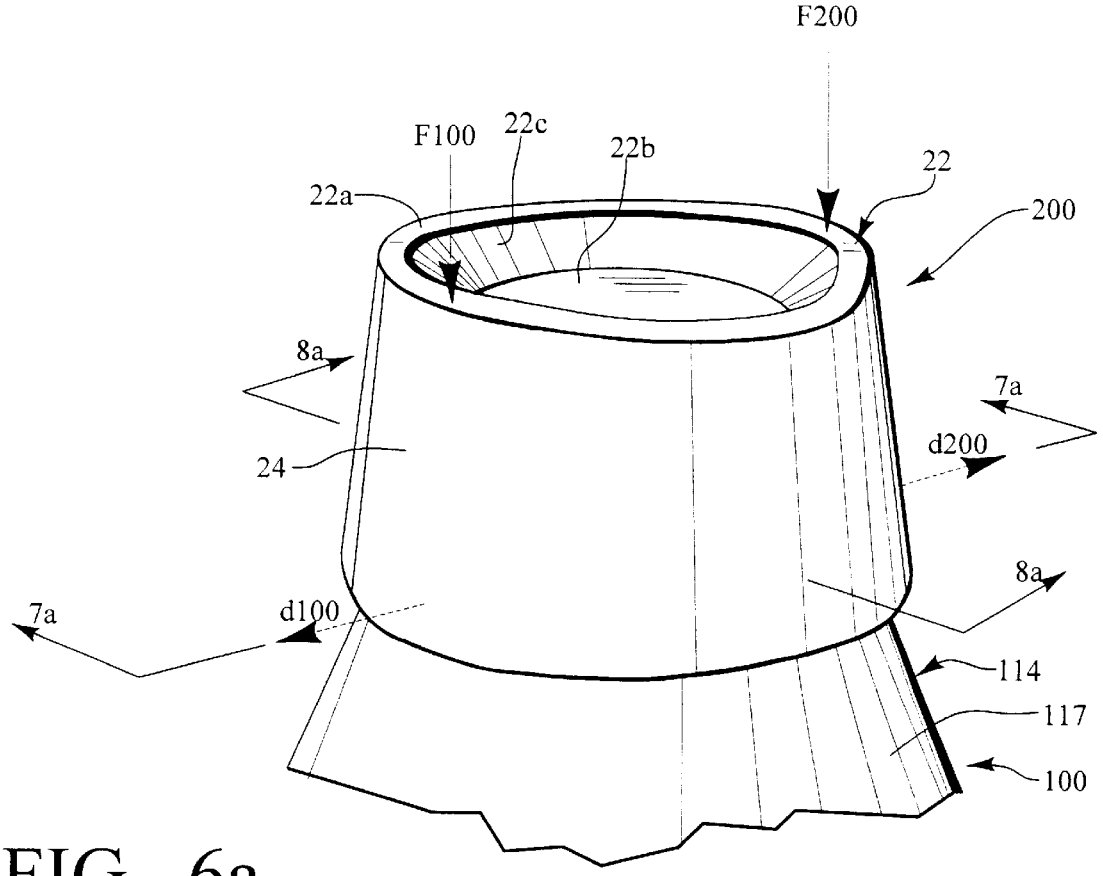
FIG. 6*a* is a perspective view of the safety closure and container neck portion of FIG. 5, wherein the safety closure is shown affixed to the container neck portion in a deformed orientation.
Figure 7:
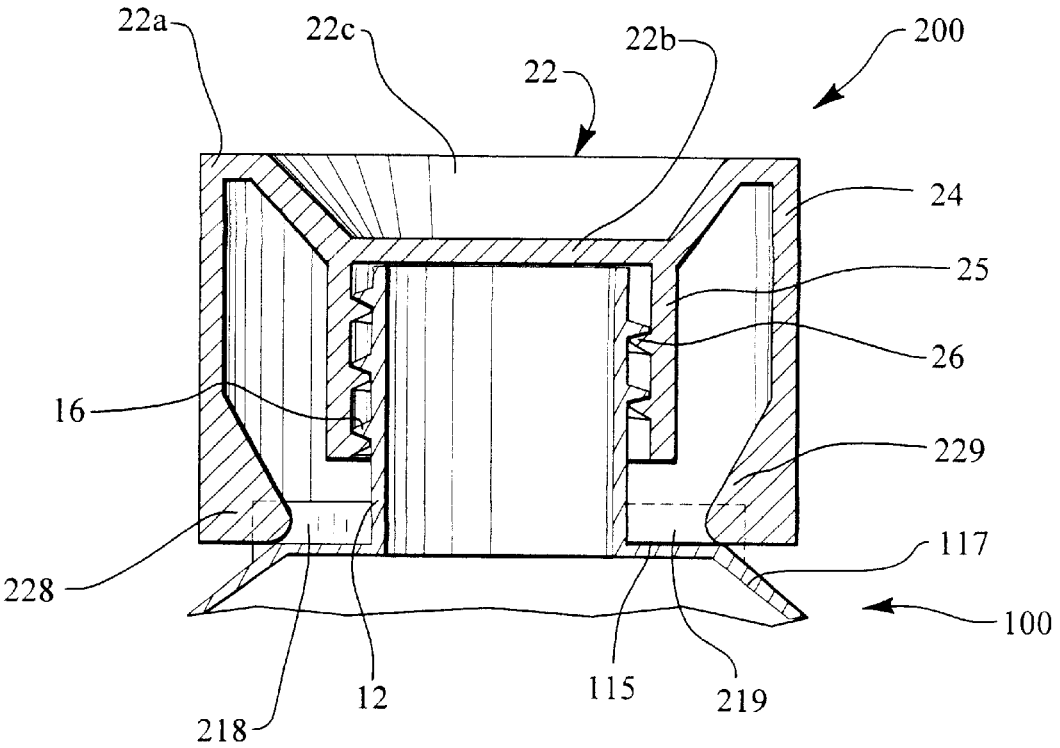
FIG. 7 is a sectional view of the safety closure and container neck portion of FIG. 2, shown along section line 7—7 of FIG. 6.
Figure 7A:
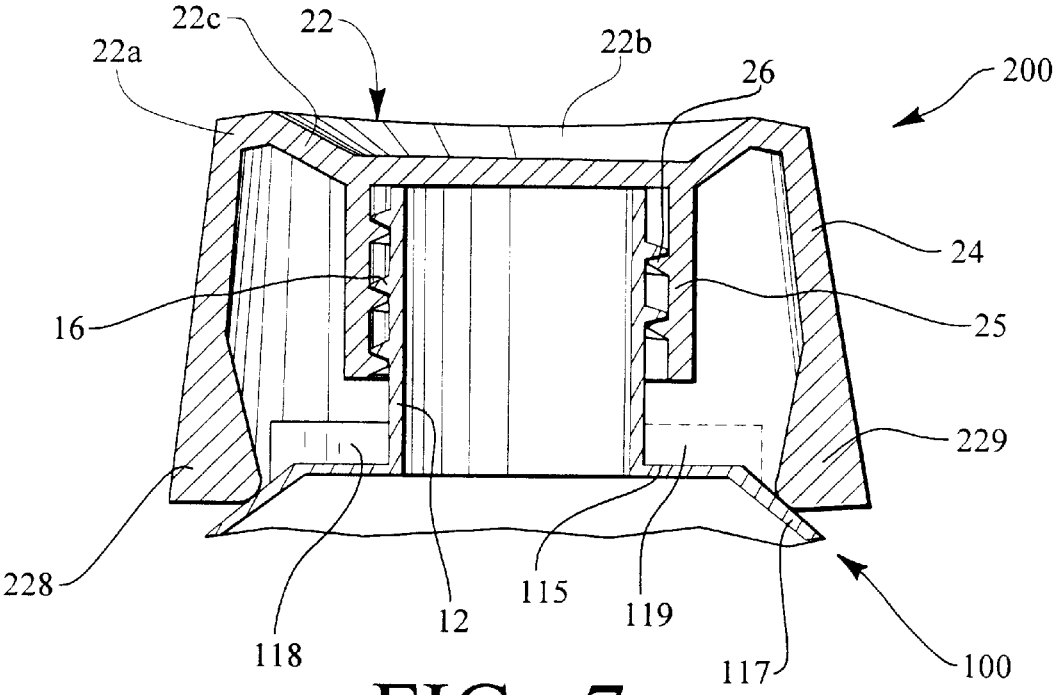
FIG. 7*a* is a sectional view of the safety closure and container neck portion of FIG. 6*a*, shown along section line 7*a*—7*a* of FIG. 6*a;*
Figure 8:
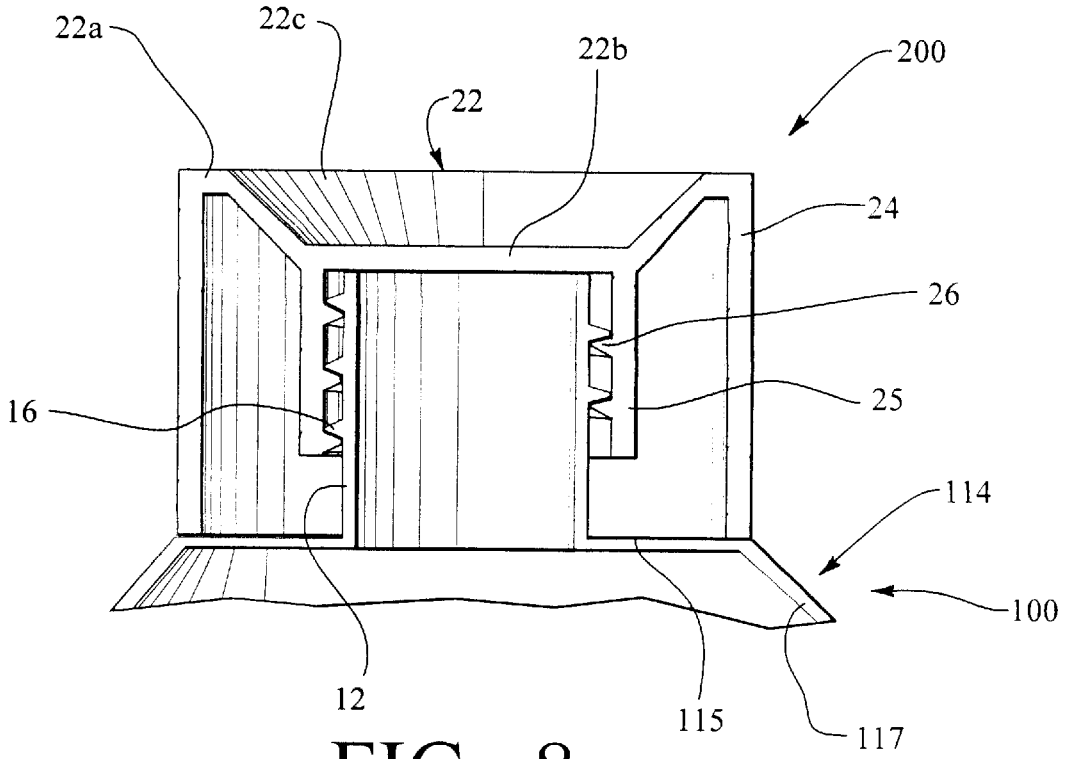
FIG. 8 is a sectional view of the safety closure and container neck portion of FIG. 6, shown along section line 8—8 of FIG. 6; and, FIG. 8*a* is a sectional view of the safety closure and container neck portion of FIG. 6*a*, shown along section line 8*a*—8*a* of FIG. 6*a*.
Figure 8A:
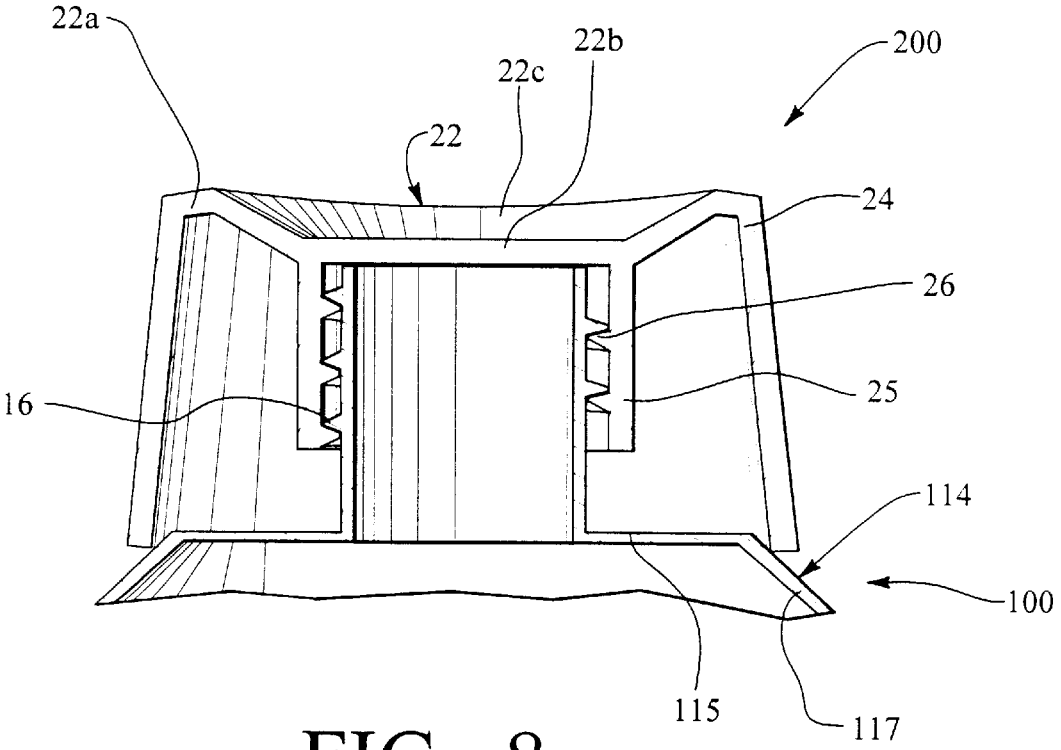

With reference to FIGS. 6*a*, 7*a* and 8*a*, the locking lugs 228, 229 are radially-outwardly moveable in the directions generally indicated by reference arrows "$d_{100}$" and "$d_{200}$" to overcome their respective abutments 118*b*, 119*b* provided by the stops 118, 119 by applying downwardly-directed force or pressure to the first top wall portion 22*a* of the top wall 22 and in the directions generally indicated by reference arrows "$F_{100}$" and "$F_{200}$". Preferably, pressure applied at force points "$F_{100}$", "$F_{200}$" is applied to the top wall 22 at annular locations immediately above the locking lugs 228, 229.

Forces "$F_{100}$", "$F_{200}$" cause the flexible outer wall 24 to pivot axially-downwardly about the outer diameter of the second top wall portion 22*b*, which remains substantially rigid and undeformed due to the internal thread 26 and the container neck portion 12 threadingly engaged therewith. The locking lugs 228, 229 move downwardly in response to pressure applied at force points "$F_{100}$", "$F_{200}$" until the locking lugs 228, 229 abut the sloped portion 117 of the container shoulder 114, which thereafter guides the locking lugs 228, 229 further axially-downwardly and radially-outwardly away from the stops 118, 119. Removal rotation of the safety closure 20 may then be applied to remove the safety closure 20 from the container neck portion 12.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

We claim:

1. A safety closure, comprising:

a top wall;

an annular outer wall depending downwardly from an outer periphery of said top wall;

an annular inner wall depending downwardly from an underside surface of said top wall;

at least one locking lug integrally molded with said outer wall, whereby downward displacement of said top wall causes outward displacement of said at least one locking lug; and an internal thread projecting inwardly from an inner surface of said inner wall.

2. The safety closure according to claim 1, said top wall further comprising:

a first top wall portion, said outer periphery of said top wall defining an outer diameter of said first top wall portion;

a second top wall portion coaxial to said first top wall portion, said second top wall portion being disposed vertically below said first top wall portion; and, a downward taper connecting an inner diameter of said first top wall portion to an outer diameter of said second top wall portion.

3. A safety closure comprising:

a top wall;

an annular outer wall depending downwardly from an outer periphery of said top wall;

an annular inner wall depending downwardly from an underside surface of said top wall; and, at least one locking lug integrally molded with said outer wall, whereby downward displacement of said top wall causes outward displacement of said at least one locking lug, said at least one locking lug depends downwardly from a lower end of said outer wall.

4. The safety closure according to claim 1, wherein:

said at least one locking lug projects inwardly from an inner surface of said outer wall.

5. A safety closure in combination with a container, comprising:

a safety closure having a top wall; an annular outer wall depending downwardly from an outer periphery of said top wall; an annular inner wall depending downwardly from an underside surface of said top wall; and, at least one locking lug depending downwardly from a lower end of said outer wall, wherein said at least one locking lug is outwardly displaceable in response to downward displacement of said top wall and depends downwardly from a lower end of said outer wall; and, a container having a shoulder integrally molded towards an open, upper end thereof; a neck portion projecting upwardly from said shoulder, said neck portion receiving said safety closure; and, at least one ramp projecting from said shoulder, wherein said at least one locking lug and said at least one ramp cooperate to provide locking means, and wherein said locking means is overcome by displacement of said at least one locking lug outwardly of said at least one ramp.

6. The safety closure and container combination according to claim 5, said top wall further comprising:

a first top wall portion, said outer periphery of said top wall defining an outer diameter of said first top wall portion;

a second top wall portion coaxial to said first top wall portion, said second top wall portion being disposed vertically below said first top wall portion; and, a downward taper connecting an inner diameter of said first top wall portion to an outer diameter of said second top wall portion.

7. The safety closure and container combination according to claim 5, wherein:

said safety closure is threadingly attached to said container neck portion.

8. The safety closure and container combination according to claim 5, wherein:

said at least one locking lug projects inwardly from an inner surface of said outer wall.

* * * * *